US005403995A

United States Patent [19]

Kishino et al.

[11] Patent Number: 5,403,995

[45] Date of Patent: Apr. 4, 1995

[54] IMAGE FIXING APPARATUS HAVING IMAGE FIXING ROLLER WITH ELECTROLYTICALLY COLORED METAL CORE

[75] Inventors: Kazuo Kishino, Kawasaki; Tomoaki Kato, Sagamihara, both of Japan

[73] Assignee: Canon Kabushiki Kaisha, Tokyo, Japan

[21] Appl. No.: 26,172

[22] Filed: Mar. 1, 1993

Related U.S. Application Data

[63] Continuation of Ser. No. 707,937, May 28, 1991, abandoned, which is a continuation of Ser. No. 256,595, Oct. 12, 1988, abandoned.

[30] Foreign Application Priority Data

Oct. 14, 1987 [JP] Japan ..... 62-257340
Jan. 28, 1988 [JP] Japan ..... 63-18206

[51] Int. Cl.[6] ..... G03G 15/20

[52] U.S. Cl. ..... 219/216; 355/290; 492/56

[58] Field of Search ..... 355/282, 285, 289, 290; 219/216, 469; 428/34.6, 35.9; 492/49, 53, 54, 56

[56] References Cited

U.S. PATENT DOCUMENTS

| | | | |
|---|---|---|---|
| 4,198,739 | 4/1980 | Budinger et al. | 29/132 |
| 4,533,231 | 8/1985 | Shigenobu | 219/216 X |
| 4,594,068 | 6/1986 | Bardutzky et al. | 219/216 X |
| 4,829,931 | 5/1989 | Mogi | 355/289 X |

FOREIGN PATENT DOCUMENTS

| | | | |
|---|---|---|---|
| 0017943 | 2/1980 | Japan | 219/469 |
| 0028602 | 3/1981 | Japan . | |
| 0133137 | 10/1981 | Japan . | |
| 0146895 | 11/1981 | Japan . | |
| 0111574 | 7/1982 | Japan | 219/469 |
| 0161796 | 9/1983 | Japan . | |
| 0056541 | 4/1984 | Japan . | |
| 59-87476 | 5/1984 | Japan . | |
| 0032081 | 2/1986 | Japan . | |
| 61-38957 | 2/1986 | Japan . | |
| 0072273 | 4/1986 | Japan . | |
| 0115071 | 5/1987 | Japan . | |

OTHER PUBLICATIONS

Communication citing foreign counter-part applications Xerox Disclosure Journal, vol. 5, No. 1 Jan./Feb. '80.

*Primary Examiner*—Robert B. Beatty
*Attorney, Agent, or Firm*—Fitzpatrick, Cella, Harper & Scinto

[57] ABSTRACT

An image fixing roller includes a core metal made of aluminum alloy and having a surface with fine recesses of 50–500 angstroms in diameter formed by providing an aluminum oxide layer on the surface of the core metal. A fluorine resin heat shrinkable tube with a shrinkage ratio of not less than 5% is wrapped directly on the core metal without use of a primer. The aluminum oxide layer and the inner surface of the core metal will be electrolytically plated with nickel so as to form a black layer.

16 Claims, 2 Drawing Sheets

IMAGE FIXING APPARATUS HAVING IMAGE FIXING ROLLER WITH ELECTROLYTICALLY COLORED METAL CORE

This application is a continuation of application Ser. No. 07/707,937 filed May 28, 1991, now abandoned, which is a continuation application of Ser. No. 07/256,595, filed Oct. 12, 1988, now abandoned.

FIELD OF THE INVENTION AND RELATED ART

The present invention relates to an image fixing roller for fixing an unfixed image and an image fixing apparatus using the same.

In the field of image fixing apparatus used in an electrophotographic machine or the like, a type wherein a pair of rotatable members, more particularly, rollers, is mainly used because of the small size thereof or the like. The fixing roller usually has a core metal made of aluminum or stainless steel and an off-set preventing layer made of fluorine resin or the like.

Japanese Laid-Open Utility Model Application No. 123668/1987 discloses that the surface of the core metal is provided with an oxide coating. In this publication, both the inside and outside surfaces of the core metal are coated with the oxide to increase the hardness, by which the wearing or damage at the bearing portions are prevented. The outer surface of the core metal is further coated with a fluorine resin layer to obtain a parting property for the image fixing roller.

However, the parting layer is sometimes peeled off, when the parting layer is formed on the oxide coating.

In a type of the image fixing roller which contains an inside heating source so as to fuse the toner by the heat therefrom, it is preferable that the roller has a good thermal conductivity. To accomplish this, it is desirable that the thickness of the primer layer between the core metal and the parting or releasing layer be very small, or that there is no such primer layer.

Japanese Laid-Open Patent Application No. 198118/1984 discloses an example without the primer layer between the core metal and the parting layer. In this case, the problem of the peeling of the parting layer is significant.

SUMMARY OF THE INVENTION

It is a principal object of the present invention to provide an image fixing roller and an image fixing apparatus using the same wherein a parting layer is strongly attached to the oxide coating on the core metal surface.

It is another object of the present invention to provide an image fixing roller and an image fixing apparatus using the same wherein both the thermal conductivity and the durability are excellent.

It is a further object of the present invention to provide an image fixing roller and an image fixing apparatus using the roller wherein the thermal efficiency of the heating source in the core metal is high.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
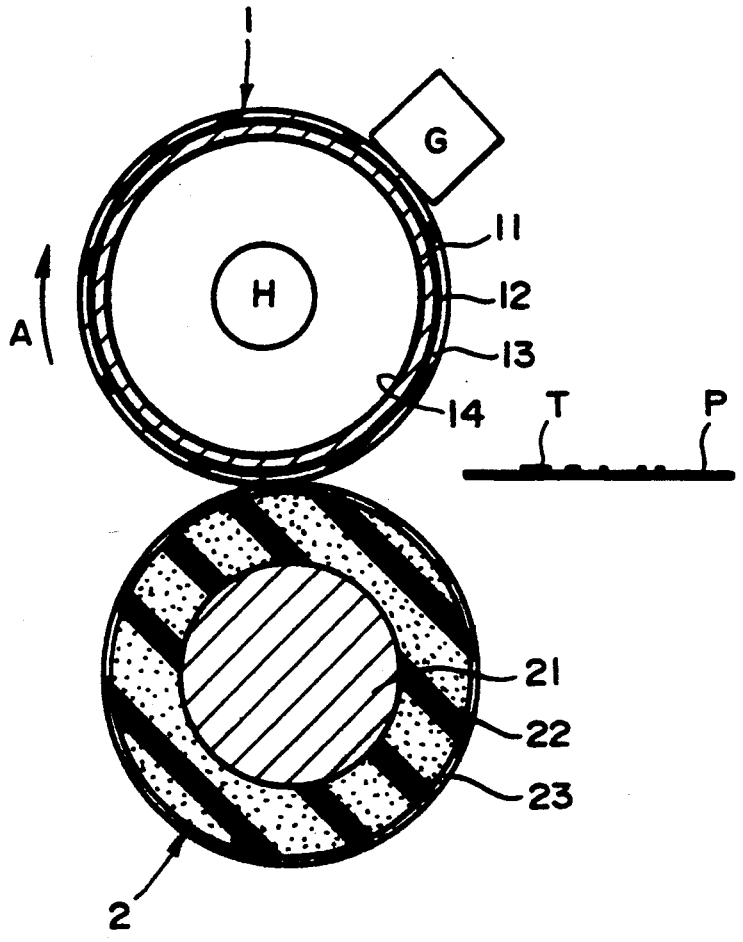
FIG. 1 is a sectional view of an image fixing apparatus according to an embodiment of the present invention.

The preferred embodiments of the present invention will be described in conjunction with the accompanying drawings wherein like reference numerals are assigned to like elements.

Referring to FIG. 1, there is shown an image fixing apparatus according to an embodiment of the present invention. An image fixing roller 1 includes an inside heating source H such as a halogen heater or the like. A back-up roller 2 is disposed contacted to the fixing roller 1. The back-up roller 2 includes a core metal 21 of stainless steel, a foamed porous layer 22 like sponge on the core metal 21 and a silicone rubber layer 23 on the porous layer 22. The porous layer 22 is produced by foaming silicone rubber.

The image fixing apparatus further includes a temperature detecting means G for detecting the surface temperature of the fixing roller 1 and controlling the surface temperature at an optimum temperature for fusing the toner, an unshown temperature control means, and an unshown driving means for rotationally driving the fixing roller 1 in the direction indicated by an arrow A at a predetermined peripheral speed.

Next, the description will be made as to an image fixing roller 1. The fixing roller 1 includes a cylindrical core metal 11 made of aluminum or aluminum alloy having an inner surface "14" being colored black, an aluminum oxide coating 12 formed by anodic oxidation of the surface of the core metal 11, and a surface layer 13. The surface layer 13 is provided by wrapping the outer periphery of the aluminum oxide layer with a heat-shrinkable fluorine resin tube without any primer layer therebetween, and then heating and fusing the fluorine resin. The surface layer 13 is good in its parting property.

The aluminum oxide coating 12 is formed by anodic oxidation of the core metal 11 surface. The electrolytic solution used for the oxidization may be sulfuric acid, oxalic acid, chromic acid and organic acid capable of forming anodic oxidation aluminum coating.

In order to form a surface layer 13 on the aluminum oxide coating, a heat shrinkable tube is used in this embodiment, as described hereinbefore. By use of the heat-shrinkable tube, strong bonding strength can be obtained between the surface layer 13 and the aluminum oxide coating without the primer layer.

The reason for this is believed to be as follows. The aluminum oxide coating, particularly the aluminum oxide coating provided by the anodic oxidation, has a large number of fine openings on the surface. The heat shrinkable tube, when being fused, extends into the fine openings by the shrinkage to provide a strong anchoring effect to provide the strong attaching or bonding force. If the parting layer is formed by a usual coating such as dispersion or electrostatic painting, the strong anchoring effect can not be provided because there is no shrinkage.

The average pore size of the aluminum oxide surface on which the heat shrinkable tube is wrapped is preferably 50–500 angstroms, particularly 100– 300 angstroms. If this range is satisfied, the strong anchoring effect is further assured. The number of the fine openings is preferably $10^8 10^{10}/cm^2$, particularly $10^9/cm^2$.

The heat-shrinkable material of the surface layer 13 is not limited, but may be any if it has a heat durability and image fixing property beyond an image fixing temperature of an image fixing apparatus in which the fixing roller is used. However, fluorine resin, particularly a copolymer of tetrafluoroethylene and fluorinated ethylene unsaturated compound, such as FEP or PFA are preferable. The thickness of the tube is preferably not more than 50 microns. The rate of heat shrinkage is not less than 5%. The peripheral circumferential length of the tube is preferably 100–101% of the outer circumferential length of the core metal.

The optimum fusing condition is different depending on the material of the tube and the thickness of the layer; the proper selection is made under the condition that the surface smoothness of the tube surface is maintained. In the above-described case where the layer has the thickness of not more than 50 microns, a heat shrinkage rate of not less than 5% and a tube circumferential length of not more than 101% of the core metal circumference, particularly 100–101% thereof, and wherein the material thereof is a fluorine heat-shrinkable tube, the fusing temperature is 300°–400° C. which is higher than the tube fusing temperature, with the heating period of approximately 5–100 minutes.

The description will be made as to Examples wherein the image fixing roller according to this embodiment is incorporated into an image fixing apparatus, and Comparison Examples.

EXAMPLE 1

The fixing roller 1 had a core metal made of a cylindrical aluminum alloy (5056) having an outer diameter of 25 mm and a thickness of 1.4 mm. The core metal was degreased, alkali-etched and thereafter anodic-oxidized in water solution of sulfuric acid (content of 15%) at liquid temperature of 20° C. for 20 minutes with current density D.C. 1.2 $A/dm^2$. The core metal was wrapped with a PFA heat-shrinkable tube having a thickness of 30 microns, outer peripheral length 79.2 mm and a heat-shrinkage ratio of 8%, which was an FST tube available from Gunze Kabushiki Kaisha, Japan, without any intermediate layer. It was kept in an electric oven at 350° C. for 30 minutes to fuse the tube on the core metal. The back-up roller had a core metal of stainless steel having a diameter of 10 mm, which was wrapped with a sponge like foamed porous silicone rubber as an elastic layer. The surface was coated with a silicone rubber layer having a thickness of approximately 1 mm to provide a back-up roller having an outer diameter of 24 mm and a surface hardness of 27 degrees (Asker C, measured at 300 g weight). The backup roller is rotatably press-contacted to the fixing roller with total pressure of 6 kg weight.

The heating means H of the fixing apparatus was a halogen heater having a power of 1.1 KW. The temperature detecting means G for detecting the surface temperature of the fixing roller 1 was an NTC thermister contacted to the fixing roller 1. The halogen heater was controlled by a known control means to maintain the surface temperature at approximately 180° C. The fixing roller 1 was rotated in the direction A at a peripheral speed of 48 mm/sec. Under these conditions, the image fixing operations were performed at 8 sheets/min for A4 size (JIS) sheet (80 $g/m^2$) having an unfixed image of a test chart. As a result, the fixing roller 1 showed good image fixing properties together with good off-set preventing property, and the image fixing properties were maintained good even after 50,000 sheets were subjected to the image fixing operation. The heat-shrinkable tube of the surface layer was not peeled or bulged, and therefore, the sufficient durability was demonstrated. The fixed images on the sheets were clear and were sufficiently fixed.

COMPARISON EXAMPLE 1

The core metal was produced in the same manner as in the above Example 1. PFA resin powder MP10 (Mitsui Fluorochemical Kabushiki Kaisha, Japan) was sprayed on the core metal in the thickness of 30 microns, and was kept in an electric oven at 350° C. and for 30 min.

The back-up roller was the same as used in the Example 1. The image fixing operations were performed under the same conditions as in Example 1. As a result, the PFA layer was partly peeled after approximately 30,000 sheets were processed, and a subsequent image fixing operation was impossible. The peeling strength of the surface layer was 600 g/cm in Example 1, whereas it was 350 g/cm in the Comparison Example 1 (the peeling strength was the peak value when the surface layer is peeled).

A Comparison Example wherein a heat-shrinkable tube is used will be described.

COMPARISON EXAMPLE 2

The core metal was similar to that of Example 1, but the surface thereof was not anodic-oxidized, and instead, it was sand-blasted for degreasing. Then, MP-902 BN (trade name, available from Mitsui Fluorochemical Kabushiki Kaisha, Japan) as a primer for painting fluorine resin paint was sprayed. After it was dried, the core metal was wrapped with the PFA heat-shrinkable tube as in Example 1. It was, then, kept in an electric oven at 380° C. for 30 min. The tube was fused on the core metal, by which the fixing roller was produced.

The reason why the primer was used is that the bonding strength of the heat shrinkable tube relative to the sand-blasted core metal is so weak that it is not practically usable. The fixing roller was incorporated into the same image fixing apparatus as in Example 1, and the same image fixing operations were performed. As a result, the toner offset takes place, and the fixing property was not so good as to be practical as an image fixing roller. The reason for this is believed to be that the amount of heat is not sufficient to fuse the toner on the surface of the fixing roller because the fluorine resin having a low thermal conductivity was applied on the core metal with the bonding layer therebetween.

COMPARISON EXAMPLE 3

The core metal similar to that used in the Example 1 was not anodic-oxidized, but was etched at its surface by keeping it for one minute in a water solution of NaOH at 50° C. of the liquid temperature (content 50%), for the purpose of providing a bonding strength between the core metal and the tube. The core metal was wrapped with a PFA heat-shrinkable tube similar to that of Example 1, and was kept in an electric oven at 350° C. for 30 min, by which the tube was fused on the core metal.

The fixing roller was incorporated into the fixing apparatus as in Example 1, and the same tests were performed.

The result was that the surface tube was peeled or damaged at a portion contacted to the thermister after approximately 30,000 sheets were processed, which meant that the service life of the roller is short. The reason is believed to be that the bonding strength is not sufficient between the surface layer tube and the core metal.

As described hereinbefore, the fixing roller of the embodiment of the present invention has a strong contact between the core metal and the heat-shrinkable fluorine resin tube wrapped on the core metal, and in addition, it has a good thermal conductivity. By using such a roller in an image fixing apparatus, a good image fixing operation can be performed.

A further preferable example of the present invention will be described.

EXAMPLE 2

Figure 3:
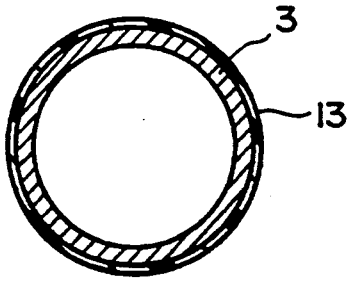
FIG. 3 is a sectional view of an image fixing roller according to a further embodiment of the present invention.

A cylindrical aluminum alloy (5056) core metal 3 having an outer diameter of 20 mm and a thickness of 2 mm was degreased by polychloroethane, and was kept in 5% water solution of NaOH (50° C.) for 30 seconds. It was anodic-oxidized for 20 min in water solution of sulfuric acid (15%) (20° C.) with current density of D.C. 1.2 A/dm$^2$. Then, it was subjected to an AC-electrolytic treatment for 3 min in an electrolytic solution bath (nickel sulfanate of 100 g/l, boric acid 30 g/l and water) at room temperature and with 10 V voltage, by which it was colored black. The core metal 3 was wrapped with PFA heat shrinkable tube 13 having a thickness of 30 microns, an outer circumferential length 63.3 mm and heat shrinkage rage of 8% (FST tube available from Gunze Kabushiki Kaisha), and it was kept in an electric oven for 30 min at 350° C. which was higher than the fusing temperature of the tube. Thus, the tube 13 was fused on an outer surface of the core metal 3, by which the fixing roller was produced (FIG. 3). Then, two rollers were produced for the purpose of making comparison with the heat fixing roller of Example 1.

COMPARISON EXAMPLE 4

The surface of the core metal similar to the fixing roller of Example 2 was not anodic-oxidized and was not colored, but was roughened by sand-blast treatment. Then, a primer MP-902BN (trade name, available from Mitsui Fluorochemical Kabushiki Kaisha, Japan) which is a primer for fluorine resin paint was sprayed on the core metal. After it was dried, it was wrapped with a PFA heat-shrinkable tube similar to that in Example 2, and was kept for 30 min in an electric oven at 380° C., by which the tube was fused on the core metal.

COMPARISON EXAMPLE 5

The core metal similar to that of the Example 2 was not anodic-oxidized and was not colored, but was kept for one minute in 5% NaOH water solution at 50° C., and the surface thereof was etched. It was then wrapped with a PFA heat-shrinkable tube similar to that of Example 2, and was kept in an electric oven for 30 min at 350° C., by which the tube was fused on the core metal.

Figure 2:
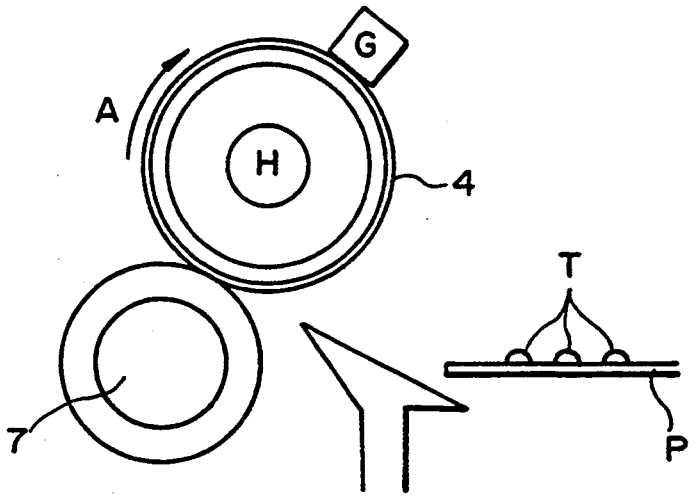
FIG. 2 is a sectional view of an image fixing apparatus according to another embodiment of the present invention.

The image fixing roller of Example 1, the image fixing rollers in Comparison Examples 4 and 5 were respectively incorporated into an image fixing apparatus of a copying machine as an image fixing roller 4, as shown in FIG. 2 to compare the performance.

As shown in FIG. 2, a halogen heater H having a power of 400 W as a heating element was disposed in the fixing roller 4, and an NTC thermister was contacted to the outer periphery of the fixing roller 4 as a temperature detecting sensor G. The temperature control was effected to keep the outer periphery of the image fixing roller 4 at approximately 150° C. A backup roller 7 was press-contacted to the fixing roller 4 with the total pressure of approximately 5 kg. The back-up roller 7 had a core metal of stainless steel having an outer diameter of 10 mm and a low hardness silicone rubber (JIS A 15 degrees) as an elastic layer. The outer diameter of the back-up roller was 16 mm. The fixing roller 4 was rotated in the direction A at a peripheral speed of 22 mm/sec by an unshown driving device. The back-up roller 7 was rotatably supported to rotate following the fixing roller 4. The rollers constituted a nip through which a recording material P carrying a toner image T formed by toner particles containing resin was passed, so that it was heated and pressed, by which the image was fixed.

Using the fixing roller of Example 2 and the fixing roller of Comparison Example 4 as the fixing roller 4 in the image fixing apparatus, A4 size (JIS) sheets (80 g/m$^2$) carrying unfixed toner images were fixed at the processing speed of 4 sheets/min. In the roller of the Comparison Example 4, the image fixing property and the off-set prevention property are both so poor that it is not practically usable. The same properties of the fixing roller of Example 2 are good. This is believed to be because the image fixing roller of Example 2 does not have the bonding layer, so that the thermal conductivity is good, and the heat absorption is good since the inside surface of the core metal 3 was colored black.

Using the fixing roller of Example 2 and the fixing roller of the Comparison Example 5, the continuous durability test was performed under the same fixing conditions for 100,000 sheets. With the roller of Comparison Example 4, the tube layer was peeled or damaged at a portion contacted to the thermister after 30,000 sheets were processed. Therefore, the service life of the roller was short. With the fixing roller of Example 2, the heat shrinkable tube 13 was not peeled even after 100,000 sheets were processed, and in addition the fixing property and the off-set preventing property were both good. In addition, since the inside surface of the core metal 3 is colored black, the temperature rise of the heater electrode mount by radiated heat does not exceed 120° C. and, therefore, is not sufficiently protected without failure due to heater break-down.

In Example 2, the aluminum oxide coating was electrolytically colored by plating nickel on the coating and therefore the bonding strength between the core metal and the heat shrinkable tube is further enhanced. The reasons are believed to be as follows:

(1) There is an interaction between metal for the coloring contained in the oxidation coating (nickel and nickel oxide in this embodiment) and fluorine resin in addition to the anchoring effect by the porousness of the oxidation coating;

(2) The surface on which the tube is to be fused is black in color, so that the heat absorption efficiency during fusing is high to enhance the fusing (and bonding) property (if the similar treatment is effected at a high temperature and for a long period of time in an attempt to provide the equivalent bonding strength with a simple aluminum oxide coating, the surface of the roller is made non-uniform by the fusing of the tube surface); the black anodic oxidation coating contains therein nickel and nickel oxide and, therefore, the heat capacity thereof is larger than the simple anodic oxidation aluminum coating, and as a result, the image fixing property is further improved; the inside surface of the core metal is partly or entirely colored black to improve the thermal efficiency, so that the image fixing property and the off-set preventing property are good. In addition, the bonding between the core metal and the heat-shrinkable tube is strong to enhance the durability, and the black coloring is effective to prevent damage of the heater itself disposed in the core metal by reflected heat.

As for the electrolytic solution used in the anodic oxidation treatment in this embodiment, it may be sulfuric acid, oxalic acid, chromic acid or another organic acid capable of forming aluminum oxide. As for the method of coloring, it may be anodic oxidation coating, or a dying method, electrolytic coloring method, secondary electrolytic coloring, or spontaneous coloring method. But it is not limited to those Examples, if the density of the color is not deteriorated when the fluorine resin is fused. However, the electrolytic coloring method is preferable since the bonding strength is enhanced with the coloring metal such as nickel.

The area on the inside surface of the core metal which is colored black is not limited, but it is preferable that the longitudinal end portions only are colored black when the heater provides a larger amount of heat in the middle, or when the heat radiation is large at the longitudinal end portions, since then the surface temperature of the roller is made uniform.

In the foregoing embodiments, the roller of the present invention is used as a roller contactable to a toner image of the toner image bearing member, but may be usable as a roller contactable to the backside of the sheet.

While the invention has been described with reference to the structures disclosed herein, it is not confined to the details set forth and this application is intended to cover such modifications or changes as may come within the purposes of the improvements or the scope of the following claims.

What is claimed is:

1. An image fixing roller, comprising:

a core metal made of aluminum or aluminum alloy and having an outer circumferential surface;

an aluminum oxide layer on the surface of the core metal, said aluminum oxide layer being coated with an electrolytically plated layer; and a parting layer on said plated layer.

2. A roller according to claim 1, wherein said aluminum oxide layer is plated with nickel.

3. A roller according to claim 1, wherein an inner surface of said core metal is also electrolytically plated.

4. A roller according to claim 1, wherein the surface of the aluminum oxide layer has a number of fine openings having an average diameter of 50–500 angstroms.

5. A roller according to claim 4, wherein a number of the fine openings is $10^8$–$10^{10}$/cm$^2$.

6. A roller according to claim 1, wherein the parting layer is in the form of heat-shrinkable tube.

7. A roller according to claim 6, wherein the tube is fused at a temperature higher than its fusing temperature.

8. A roller according to claim 7, wherein the tube has a thickness of not more than 50 microns, a heat shrinkage ratio of not less than 5% and an outer circumferential length of 100–101% of the outer circumferential length of the core metal.

9. An image fixing apparatus, comprising:

an image fixing roller contactable to an unfixed image; and a back-up rotatable member disposed opposed to said fixing roller, said fixing roller comprising:

a core metal made of aluminum or aluminum alloy and having an outer circumferential surface;

an aluminum oxide layer on the surface of the core metal, said aluminum oxide layer being coated with an electrolytically plated layer; and a parting layer on said plated layer.

10. An apparatus according to claim 9, wherein said aluminum oxide layer is plated with nickel.

11. An apparatus according to claim 9, wherein an inner surface of said core metal is also electrolytically plated.

12. An apparatus according to claim 9, wherein the surface of the aluminum oxide layer has a number of fine openings having an average diameter of 50–500 angstroms.

13. An apparatus according to claim 12, wherein a number of the fine openings is $10^8$–$10^{10}$/cm$^2$.

14. An apparatus according to claim 9, wherein the parting layer is in the form of heat-shrinkable tube.

15. An apparatus according to claim 14, wherein the tube is fused at a temperature higher than its fusing temperature.

16. An apparatus according to claim 14, wherein the tube has a thickness of not more than 50 microns, a heat shrinkage ratio of not less than 5% and an outer circumferential length of 100–101% of the outer circumferential length of the core metal.

* * * * *

UNITED STATES PATENT AND TRADEMARK OFFICE

CERTIFICATE OF CORRECTION

PATENT NO. : 5,403,995

DATED : April 4, 1995

INVENTOR(S) : KAZUO KISHINO, ET AL.

It is certified that error appears in the above-indentified patent and that said Letters Patent is hereby corrected as shown below:

Column 1, line 29, "the" (first occurrence) should be deleted.

Column 3, line 8, "$10^8 10^{10}/cm^2$," should read --$10^8$-$10^{10}/cm^2$,--;

line 10, "any" should read --any such material--; and line 66, "thermister" should read --thermistor--.

Column 5, line 8, "thermister" should read --thermistor--.

Column 6, line 8, "thermister" should read --thermistor--; and line 45, "thermister" should read --thermistor--.

Signed and Sealed this

Eighteenth Day of July, 1995

Bruce Lehman

*Attest:*

BRUCE LEHMAN

*Attesting Officer*

*Commissioner of Patents and Trademarks*